US010957476B2

(12) United States Patent
Moon et al.

(10) Patent No.: US 10,957,476 B2
(45) Date of Patent: Mar. 23, 2021

(54) COIL ELECTRONIC COMPONENT

(71) Applicant: SAMSUNG ELECTRO-MECHANICS CO., LTD., Suwon-Si (KR)

(72) Inventors: Byeong Cheol Moon, Suwon-Si (KR); Il Jin Park, Suwon-Si (KR); Se Hyung Lee, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 46 days.

(21) Appl. No.: 15/833,638

(22) Filed: Dec. 6, 2017

(65) Prior Publication Data

US 2018/0108469 A1 Apr. 19, 2018

Related U.S. Application Data

(62) Division of application No. 15/009,314, filed on Jan. 28, 2016, now abandoned.

(30) Foreign Application Priority Data

Apr. 16, 2015 (KR) ..... 10-2015-0054036

(51) Int. Cl.
*H01F 27/29* (2006.01)
*H01F 27/255* (2006.01)
*H01F 17/00* (2006.01)

(52) U.S. Cl.
CPC ..... *H01F 27/255* (2013.01); *H01F 17/0033* (2013.01); *H01F 27/292* (2013.01)

(58) Field of Classification Search
CPC .. H01F 17/04; H01F 2017/0066; H01F 27/55; H01F 41/61; H01F 17/0013;
(Continued)

(56) References Cited

U.S. PATENT DOCUMENTS 4,096,581 A * 6/1978 Carlo ..... G11C 19/085 365/2
5,194,806 A * 3/1993 Obama ..... G01B 7/24 29/621.1

(Continued)

FOREIGN PATENT DOCUMENTS

CN 102449710 A 5/2012
CN 103366919 A 10/2013

(Continued)

OTHER PUBLICATIONS

Korean Office Action dated Apr. 14, 2016, issued in Korean patent application No. 10-2015-0054036. (w/ English abstract).

(Continued)

*Primary Examiner* — Alexander Talpalatski
*Assistant Examiner* — Joselito S. Baisa
(74) *Attorney, Agent, or Firm* — Morgan, Lewis & Bockius LLP

(57) ABSTRACT

A coil electronic component includes a body including metal powder particles having shape anisotropy and a coil unit disposed in the body and having an axis perpendicular with respect to a thickness direction of the body. The metal powder particles having shape anisotropy are arranged such that a plane-shaped surface thereof is parallel to a direction of flow of magnetic flux.

14 Claims, 13 Drawing Sheets

(58) Field of Classification Search
CPC ..... H01F 2027/2809; H01F 17/0033; H01F 27/36; H01F 27/28
USPC ..... 336/200, 192
See application file for complete search history.

(56) References Cited

U.S. PATENT DOCUMENTS 5,476,728 A * 12/1995 Nakano ..... H01F 1/0027 252/62.58
5,643,804 A * 7/1997 Arai ..... H01L 25/16 438/155
5,662,754 A * 9/1997 Marusawa ..... H01P 1/387 156/145
5,925,455 A * 7/1999 Bruzzone ..... B65D 81/3446 428/328
6,051,156 A * 4/2000 Yoshida ..... H01F 1/0027 252/62.54
6,063,303 A * 5/2000 Ohtaki ..... H01F 1/24 106/460
6,326,314 B1 * 12/2001 Merrill ..... H01L 28/10 216/2
6,392,525 B1 * 5/2002 Kato ..... H01F 3/08 336/200
6,869,884 B2 * 3/2005 Chan ..... H01L 21/26506 438/705
6,948,230 B2 9/2005 Ahn et al.
6,962,753 B1 * 11/2005 Yoshida ..... H01L 23/3733 257/E23.107
7,034,646 B2 4/2006 Yamamoto et al.
7,261,240 B2 * 8/2007 Akiho ..... G06K 7/0008 235/449
7,380,328 B2 * 6/2008 Ahn ..... H01F 17/0013 29/602.1
7,388,462 B2 6/2008 Ahn et al.
7,733,207 B2 * 6/2010 Yun ..... H01F 17/0013 336/200
7,859,377 B2 * 12/2010 Kawarai ..... H01F 17/0006 336/83
8,354,037 B2 * 1/2013 Harada ..... B22F 1/0018 252/62.53
8,675,368 B2 * 3/2014 Cho ..... H01L 23/5227 361/777
8,824,165 B2 * 9/2014 Chen ..... H05K 1/181 257/637
8,896,407 B2 11/2014 Chatani et al.
8,902,067 B2 * 12/2014 Saito ..... G07C 9/20 340/572.7
8,975,997 B2 3/2015 Tonoyama et al.
9,252,611 B2 * 2/2016 Lee ..... H05K 9/0088
9,724,080 B2 * 8/2017 Corrao ..... A61B 17/0057
9,859,610 B2 * 1/2018 Ito ..... H01Q 1/2225
2002/0053992 A1 * 5/2002 Kawakami ..... H01Q 1/22 343/767
2005/0068150 A1 * 3/2005 Matsutani ..... H01F 17/04 336/223
2006/0022782 A1 * 2/2006 Sato ..... H01F 7/021 335/302
2006/0145808 A1 * 7/2006 Von Behr ..... H01H 39/006 337/401
2008/0284262 A1 * 11/2008 Nelson ..... C08K 3/14 310/52
2009/0002117 A1 * 1/2009 Kawarai ..... H01F 17/0006 336/233
2010/0156735 A1 * 6/2010 Nakamura ..... H01Q 1/38 343/788
2010/0289609 A1 * 11/2010 Liao ..... H01F 17/04 336/221
2011/0115596 A1 * 5/2011 Lai ..... H01F 27/325 336/198
2012/0062435 A1 * 3/2012 Kato ..... H01Q 7/06 343/787
2012/0105188 A1 5/2012 Lim et al.
2013/0169401 A1 * 7/2013 Lee ..... H01F 27/29 336/192
2013/0214888 A1 8/2013 Nogi et al.
2013/0249662 A1 9/2013 Tonoyama et al.
2013/0263440 A1 * 10/2013 Lee ..... H01F 41/04 29/605
2014/0049212 A1 * 2/2014 Sawa ..... H01F 27/365 320/108
2014/0145815 A1 5/2014 Ishii et al.
2014/0167897 A1 * 6/2014 Choi ..... H01F 27/255 336/83
2014/0218147 A1 8/2014 Chatani et al.
2015/0102892 A1 * 4/2015 Yeo ..... H01F 1/14716 336/200
2015/0123604 A1 * 5/2015 Lee ..... B32B 38/0004 320/108
2015/0145632 A1 * 5/2015 Fukuzawa ..... H01F 38/14 336/221
2015/0162118 A1 * 6/2015 Kato ..... H01F 1/28 336/221
2015/0235753 A1 8/2015 Chatani et al.
2016/0172098 A1 * 6/2016 Jeong ..... H01F 27/365 336/90
2016/0276096 A1 * 9/2016 Moon ..... H01F 27/2804
2016/0343498 A1 * 11/2016 Lee ..... H01G 4/005

FOREIGN PATENT DOCUMENTS

CN 104011814 A 8/2014
JP 10-335142 A 12/1998
JP 2003-077728 A 3/2003
JP 2006-210847 A 8/2006
JP 2013-243330 A 12/2013
JP 2014-168038 A 9/2014
KR 10-2010-0048250 A 5/2010
KR 10-2010-0119641 A 11/2010

OTHER PUBLICATIONS

First Office Action issued in Chinese Patent Application No. 201610085640.6, dated Aug. 2, 2017 (With English Translation).
Office Action issued in U.S. Appl. No. 15/009,314, dated Oct. 26, 2017.
Chinese Office Action issued in corresponding Chinese Patent Application No. 201610085640.6, dated Dec. 14, 2017, with English Translation.

* cited by examiner

COIL ELECTRONIC COMPONENT

CROSS-REFERENCE TO RELATED APPLICATION

This application is a division of U.S. application Ser. No. 15/009,314 filed on Jan. 28, 2016, which claims the benefit of priority to Korean Patent Application No. 10-2015-0054036, filed on Apr. 16, 2015 with the Korean Intellectual Property Office, the entirety of which is incorporated herein by reference.

TECHNICAL FIELD

The present disclosure relates to a coil electronic component.

BACKGROUND

An inductor, a type of coil electronic component, is a passive element that can be used together with a resistor and a capacitor in an electronic circuit to cancel noise therefrom.

An inductor may be manufactured by forming a magnetic material around a coil unit and forming external electrodes connected to the coil unit. Ferrite, which may be generally used as a magnetic material, has a very low saturation magnetization value, such that there is a limitation in that inductance thereof may be greatly changed according to current application. Thus, research into an inductor using a metal having a high saturation magnetization value as a magnetic material is ongoing.

SUMMARY

An aspect of the present disclosure provides a coil electronic component having high inductance (L) as well as an excellent quality (Q) factor and DC-bias properties (change characteristics of inductance according to current application).

According to an aspect of the present disclosure, a coil electronic component includes a metal powder particle having shape anisotropy or a magnetic metal plate formed around a coil unit, in which the metal powder particle having shape anisotropy or the magnetic metal plate are arranged to be oriented in a direction of flow of magnetic flux generated by the coil unit.

According to an aspect of the present disclosure, a coil electronic component comprises a body including metal powder particles having shape anisotropy; and a coil unit disposed in the body and having an axis perpendicular with respect to a thickness direction of the body. The metal powder particles having shape anisotropy are arranged such that a plane-shaped surface thereof is parallel to a direction of flow of magnetic flux.

The coil unit may include an upper pattern formed on an upper surface of the body, a lower pattern formed on a lower surface of the body, and first and second through conductors connecting the upper and lower patterns through the body and spaced apart from one another.

First and second insulating layers may be formed on the upper and lower surfaces of the body, respectively.

The axis of the coil unit may be parallel to a width direction of the body.

The axis of the coil unit may be parallel to a length direction of the body.

The coil distance between the first and second through conductors may be 1.8 to 2.2 times a distance between at least one of the first and second through conductors and a surface of the body most adjacent thereto in a length direction or a width direction.

A cross-section of the first and second through conductors in a length-width direction is circular, oval, semi-ovate, or quadrangular.

The coil electronic component may further comprise first and second external electrodes extending from a portion of the lower pattern of the coil unit and disposed on a lower surface of the body.

The coil electronic component may further comprise first and second external electrodes formed on a lower surface of the second insulating layer and electrically connected to the coil unit by a via penetrating through the second insulating layer.

A cross-section of the first and second through conductors in a length-width direction may be quadrangular and at least one surface of each outermost through conductors may be convex.

According to another aspect of the present disclosure, a coil electronic component comprises a body including a magnetic metal plate; and a coil unit disposed in the body and having an axis perpendicular with respect to a thickness direction of the body. The magnetic metal plate is arranged to be parallel to a direction of flow of magnetic flux.

The coil unit includes an upper pattern formed on an upper surface of the body, a lower pattern formed on a lower surface of the body, and first and second through conductors connecting the upper and lower patterns through the body and spaced apart from one another.

First and second insulating layers may be formed on the upper and lower surfaces of the body, respectively.

A thermosetting resin layer may be formed on at least one surface of the magnetic metal plate.

The magnetic metal plate may be cracked to include a plurality of metal fragments.

Spaces between the plurality of adjacent metal fragments contain a thermosetting resin.

The magnetic metal plate may be cracked such that adjacent metal fragments have shapes corresponding to each other.

According to another aspect of the present disclosure, a coil electronic component comprises a coil unit; and a body containing metal powder particles having shape anisotropy wherein the metal powder particles have at least one major axis in a first direction that is greater in length than a minor axis of the metal powder particle in a second direction. The coil unit has an axis parallel to at least one of the major axis of the metal powder particles having shape anisotropy.

BRIEF DESCRIPTION OF DRAWINGS

The above and other aspects, features and other advantages of the present disclosure will be more clearly understood from the following detailed description taken in conjunction with the accompanying drawings.

DETAILED DESCRIPTION

Figure 1:
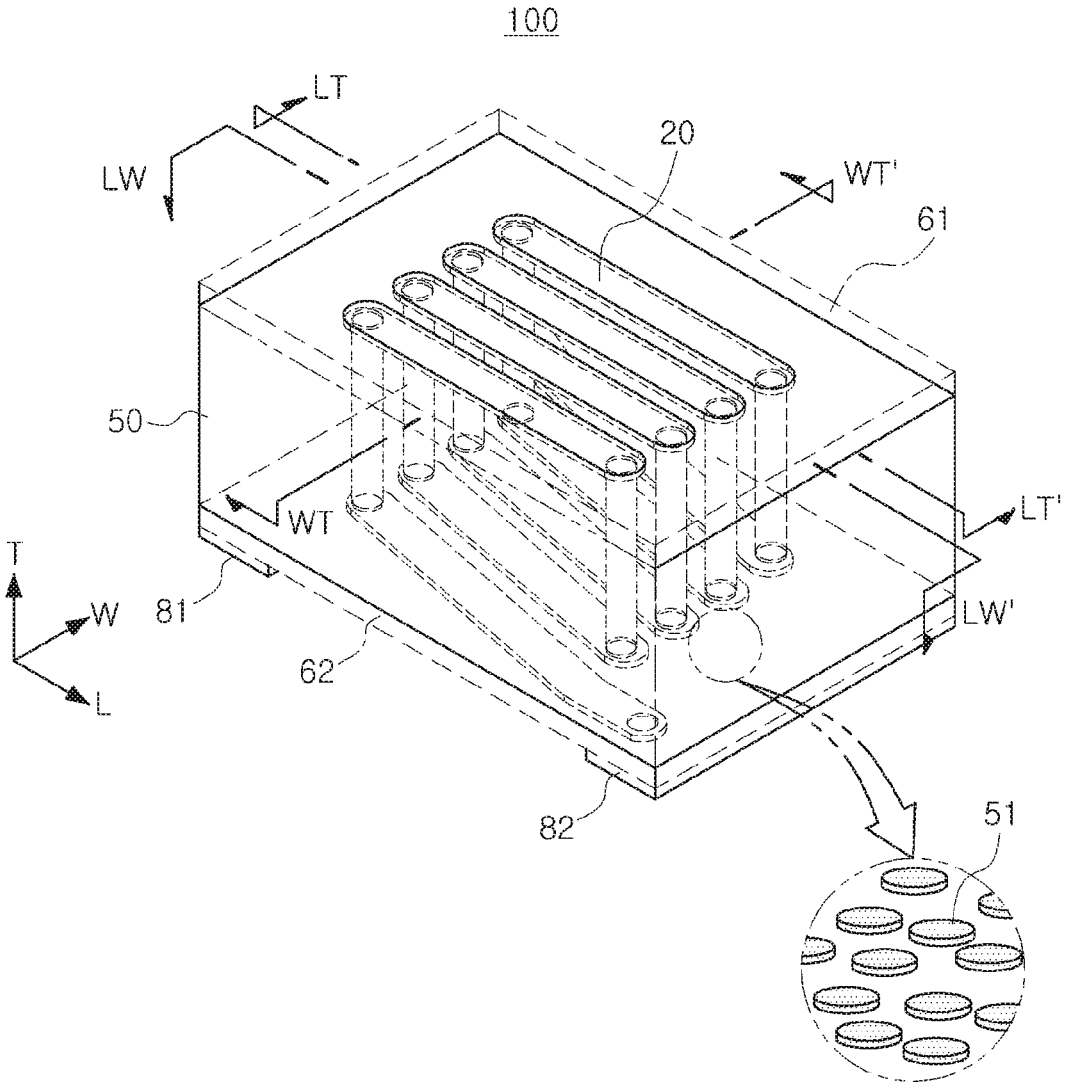
FIG. 1 is a perspective view schematically illustrating a coil electronic component including a coil unit according to an exemplary embodiment in the present disclosure.

Hereinafter, embodiments of the present inventive concept will be described as follows with reference to the attached drawings.

The present inventive concept may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers and/or sections, these members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the exemplary embodiments.

Spatially relative terms, such as "above," "upper," "below," and "lower" and the like, may be used herein for ease of description to describe one element's relationship to another element(s) as shown in the figures. It will be understood that the spatially relative terms are intended to encompass different orientations of the device in use or operation in addition to the orientation depicted in the figures. For example, if the device in the figures is turned over, elements described as "upper," or "above" other elements would then be oriented "lower," or "below" the other elements or features. Thus, the term "above" can encompass both the above and below orientations depending on a particular direction of the figures. The device may be otherwise oriented (rotated 90 degrees or at other orientations) and the spatially relative descriptors used herein may be interpreted accordingly.

The terminology used herein is for describing particular embodiments only and is not intended to be limiting of the present inventive concept. As used herein, the singular forms "a," "an," and "the" are intended to include the plural forms as well, unless the context clearly indicates otherwise. It will be further understood that the terms "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present inventive concept will be described with reference to schematic views illustrating embodiments of the present inventive concept. In the drawings, for example, due to manufacturing techniques and/or tolerances, modifications of the shape shown may be estimated. Thus, embodiments of the present inventive concept should not be construed as being limited to the particular shapes of regions shown herein, for example, to include a change in shape results in manufacturing. The following embodiments may also be constituted by one or a combination thereof.

The contents of the present inventive concept described below may have a variety of configurations and propose only a required configuration herein, but are not limited thereto.

Coil Electronic Component

FIG. 1 is a perspective view schematically illustrating a coil electronic component including a coil unit according to an exemplary embodiment in the present disclosure.

Referring to FIG. 1, a coil electronic component 100 according to an exemplary embodiment in the present disclosure includes a body 50 including metal powder particles having shape anisotropy 51, a coil unit 20 disposed in the body 50, and first and second external electrodes 81 and 82 disposed on external surfaces of the body 50 and electrically connected to the coil unit 20.

In the coil electronic component 100 according to an exemplary embodiment in the present disclosure, it is defined that a length direction is the "L" direction, a width direction is the "W" direction, and a thickness direction is the "T" direction in FIG. 1.

The coil unit 20 may be formed to have an axis perpendicular to the thickness (T) direction of the body 50. When a current is applied to the vertically positioned coil unit 20, most magnetic flux flows in a length-width (LW) cross-sectional direction of the body 50.

In an exemplary embodiment in the present disclosure, the coil unit 20 is formed to have an axis perpendicular to the thickness (T) direction of the body 50 and the metal powder particles having shape anisotropy 51 are arranged such that a plane-shaped surface 51' thereof is parallel to the direction in which magnetic flux generated by the coil unit 20 flows. That is, the metal powder particles having shape anisotropy 51 are arranged such that the plane-shaped surface 51' is parallel to the length-width (LW) cross-section of the body 50.

Figure 2:
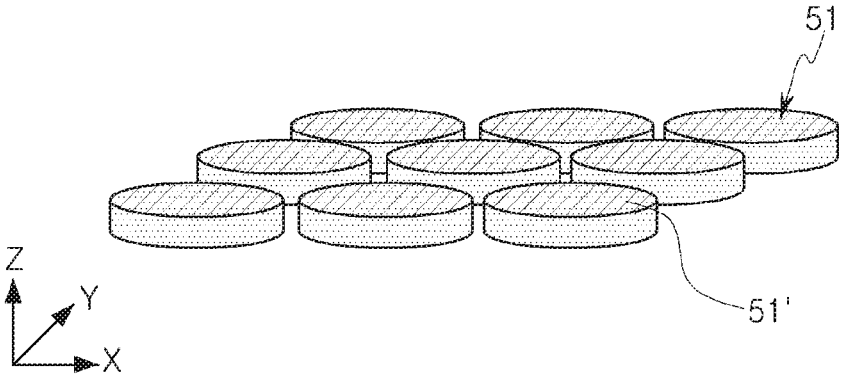
FIG. 2 is an enlarged perspective view of metal powder particles having shape anisotropy.

FIG. 2 is an enlarged perspective view of metal powder particles having shape anisotropy.

As illustrated in FIG. 2, the metal powder particles having shape anisotropy 51 may be plane-shaped metal powder particles. However, the shape of the metal powder particles having shape anisotropy 51 is not limited thereto.

The metal powder particles having shape anisotropy 51 may be different in shape in the X, Y, and Z-axis directions, and may have different characteristics in the X, Y, and Z-axis directions.

In general, a metal powder particle having shape anisotropy exhibits higher magnetic permeability than a metal powder particles having shape isotropy, for example spherical isotropic metal powder particles. Thus, in order to enhance inductance (L), a coil electronic component including the metal powder particles having shape anisotropy 51 having magnetic permeability higher than that of the metal powder particles having shape isotropy may be manufactured.

However, magnetic permeability of the metal powder particle having shape anisotropy 51 differs according to directions. Thus, even though overall magnetic permeability of the metal powder particles having shape anisotropy 51 is higher than that of the metal powder particles having shape isotropy, magnetic permeability thereof in a particular direction may be low, such that it may hinder a flow of magnetic flux generated by a current applied to the coil unit 20.

For example, in the metal powder particles having shape anisotropy 51 illustrated in FIG. 2, magnetic permeability in the X-axis and Y-axis directions on the plane-shaped surface 51' is high, but is lower in the Z-axis direction. Thus, the metal powder particles having shape anisotropy 51 may hinder a flow of magnetic flux flowing in the Z-axis direction perpendicular to the plane-shaped surface 51', resultantly reducing inductance (L).

The metal powder particles having shape anisotropy 51 may include one or more major axes corresponding to a longer axis, and one or more minor axes corresponding to a shorter axis. For example, referring to FIG. 2, the metal powder particles having shape anisotropy 51 would have major axes in the X-axis and Y-axis direction, and a minor axis in the Z-axis direction.

In an exemplary embodiment in the present disclosure, the coil unit 20 is formed to have an axis perpendicular with respect to the thickness (T) direction of the body 50 and the metal powder particles having shape anisotropy 51 are arranged such that the plane-shaped surface 51' of the metal powder particles having shape anisotropy 51 is parallel to the direction of flow of magnetic flux generated by the coil unit 20, thereby allowing magnetic flux to flow smoothly and enhancing the inductance (L) through high magnetic permeability. Also, an excellent Q factor and DC-bias characteristics may be obtained by a high saturation magnetization value (Ms) of the metal powder particles having shape anisotropy 51.

The metal powder particles having shape anisotropy 51 may be formed of a metal including one or more selected from the group consisting of iron (Fe), silicon (Si), boron (B), chromium (Cr), aluminum (Al), copper (Cu), niobium (Nb), and nickel (Ni), or alloys thereof, and may be a crystalline metal or an amorphous metal.

For example, the metal powder particles having shape anisotropy 51 or the metal powder particles having shape isotropy may be a Fe—Si—Cr-based amorphous metal, but the material thereof is not limited thereto.

The metal powder particles having shape anisotropy 51 and the metal powder particles having shape isotropy may be included in a dispersed manner in a thermosetting resin.

The thermosetting resin may be, for example, epoxy or polyimide.

Figure 3:
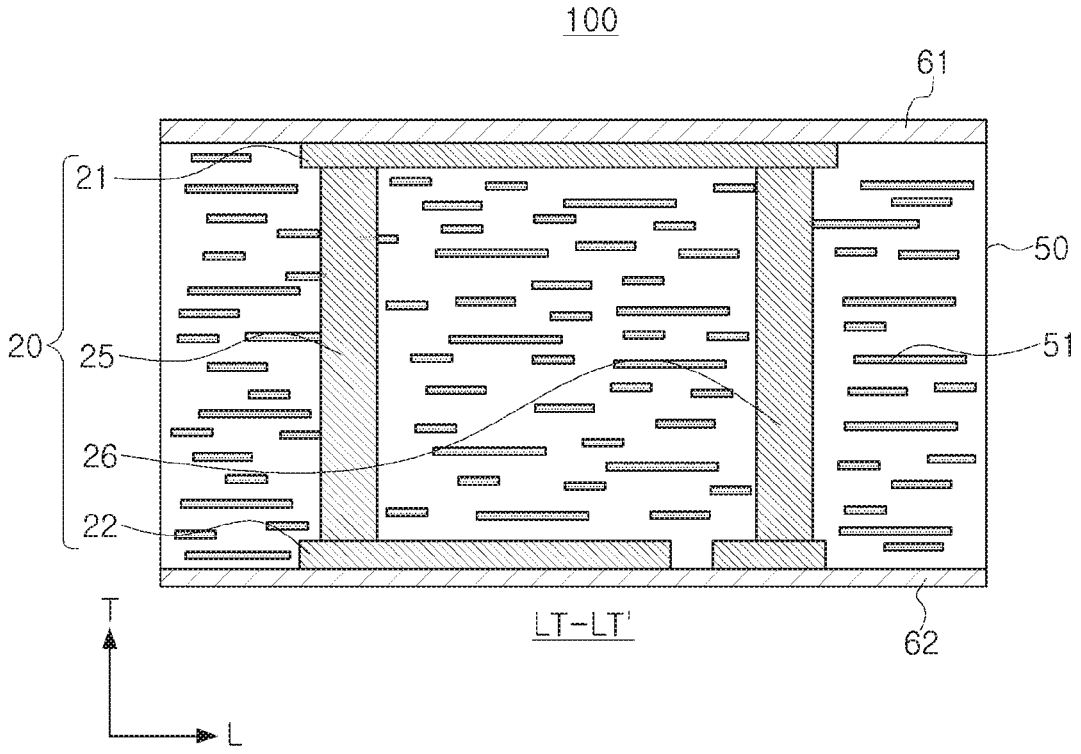
FIG. 3 is a cross-sectional view taken along line LT-LT' of FIG. 1.
Figure 4:
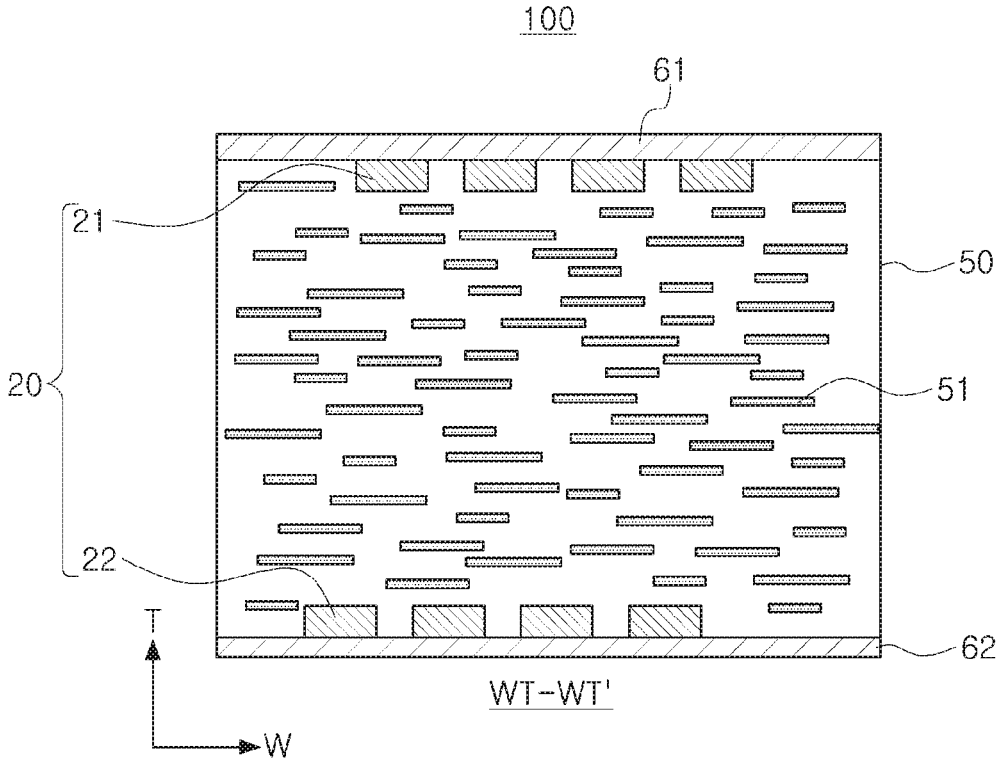
FIG. 4 is a cross-sectional view taken along line WT-WT' of FIG. 1.

FIG. 3 is a cross-sectional view taken along line LT-LT' of FIG. 1, and FIG. 4 is a cross-sectional view taken along line WT-WT' of FIG. 1.

Referring to FIGS. 3 and 4, the coil unit 20 includes an upper pattern 21 formed on an upper surface of the body 50, a lower pattern 22 formed on a lower surface of the body 50, and first and second through conductors 25 and 26 connecting the upper pattern 21 and the lower pattern 22 and disposed to be spaced apart from one another by a predetermined distance.

The coil unit 20 may be formed of a conductive metal having excellent electrical conductivity, and for example, the first and second coil conductors 41 and 42 may be formed of silver (Ag), palladium (Pd), aluminum (Al), nickel (Ni), titanium (Ti), gold (Au), copper (Cu), platinum (Pt), or alloys thereof.

As illustrated in FIGS. 3 and 4, the upper pattern 21 and the lower pattern 22 may be formed such that portions thereof are exposed to the upper and lower surfaces of the body 50, but the configuration of the upper pattern 21 and the lower pattern 22 is not limited thereto and the upper pattern 21 and the lower pattern 22 may be formed on the upper and lower surfaces or may be completely embedded in upper and lower portions of the body 50.

The upper pattern 21 and the lower pattern 22 may be formed such that portions thereof are exposed or may be formed on the upper and lower surfaces, whereby an area of a core part on the inner side of the coil unit 20 on which magnetic flux concentrates may be increased, while allowing magnetic flux to substantially flow only in the length-width (L-W) cross-sectional direction. The increase in the area of the core part may lead to enhancement of inductance (L) and improvement of efficiency (Q factor).

The body 50 in which the coil unit 20 is disposed may be manufactured by forming a sheet including the metal powder particles having shape anisotropy 51, forming a via in a predetermined position of a plurality of sheets, forming upper and lower patterns 21 and 22 on some of the sheets, and performing stacking and compressing operation thereon.

The sheet may be manufactured by mixing an organic material such as a binder or a solvent with the metal powder particles having shape anisotropy to prepare slurry, applying the slurry to a carrier film through a doctor blade method, and drying the slurry.

The via and/or the upper and lower patterns 21 and 22 may be formed by applying the conductive paste including a conductive metal through a printing method, or the like. As the method of printing the conductive paste, a screen printing method or a Gravure printing method may be used.

Alternatively, in order to manufacture the body 50 in which the coil unit 20 is disposed, a metal powder-organic material complex including the metal powder particles having shape anisotropy 51 may be formed. Subsequently, electroplating may be performed on the metal power-organic material complex to form the coil unit 20.

However, the method of forming the body 50 is not limited thereto, and as in an exemplary embodiment in the present disclosure, any method may be applied as long as it allows for the coil unit 20 to be formed to have an axis perpendicular with respect to the thickness (T) direction of the body 50 and metal powder particles having shape anisotropy 51 to be arranged such that a plane-shaped surface 51' thereof is parallel to the direction of flow of magnetic flux.

Furthermore, as shown in FIGS. 3 and 4, the metal powder particles having shape anisotropy 51 are such that a major axis thereof is parallel to the direction of flow of magnetic flux, and a minor axis thereof is perpendicular to the direction of flow of magnetic flux.

First and second insulating layers 61 and 62 may be formed on the upper surface of the body 50 on which the upper pattern 21 of the coil unit 20 is formed and the lower surface of the body 50 on which the lower pattern 22 of the coil unit 20 is formed.

Since upper pattern 21 and lower pattern 22 are exposed to the upper and lower surfaces of the body 50 or formed on the upper and lower surfaces of the body 50, the area of the core part on the inner side of the coil unit 20 on which magnetic flux concentrates may be maximized and the first and second insulating layers 61 and 62 are formed on upper and lower surfaces of the body 50.

In an exemplary embodiment in the present disclosure, magnetic flux may flow substantially in the length-width (L-W) cross-sectional direction, rather than in the thickness (T) direction. Thus, there is no need to forma magnetic material on the upper pattern 21 and below the lower pattern 22 and the insulating layers 61 and 62 may be formed on the upper pattern 21 and below the lower pattern 22.

Figure 5:
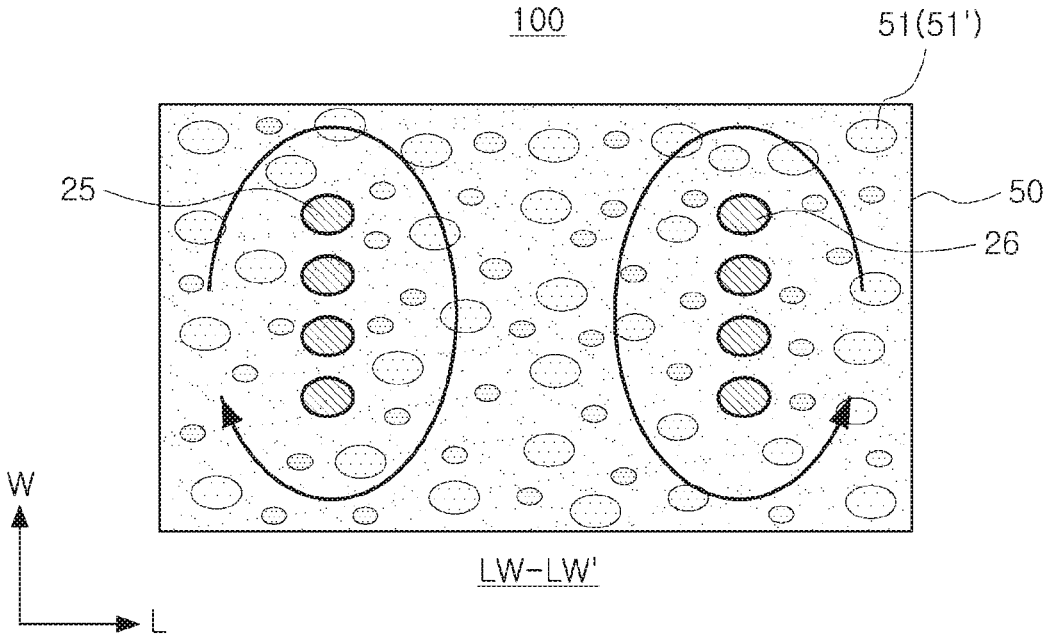
FIG. 5 is a cross-sectional view taken along line LW-LW' of FIG. 1.

FIG. 5 is a cross-sectional view taken along line LW-LW' of FIG. 1.

Referring to FIG. 5, in the coil electronic component 100 according to an exemplary embodiment in the present disclosure, magnetic flux generated by the coil unit 20 substantially flows in the length-width (L-W) cross-section of the body 50, and the metal powder particles having shape anisotropy 51 are arranged such that a plane-shaped surface 51' thereof is parallel to the length-width (L-W) cross-section of the body 50.

Thus, magnetic flux may flow smoothly and high magnetic permeability may be obtained, enhancing inductance (L).

Figure 6A:
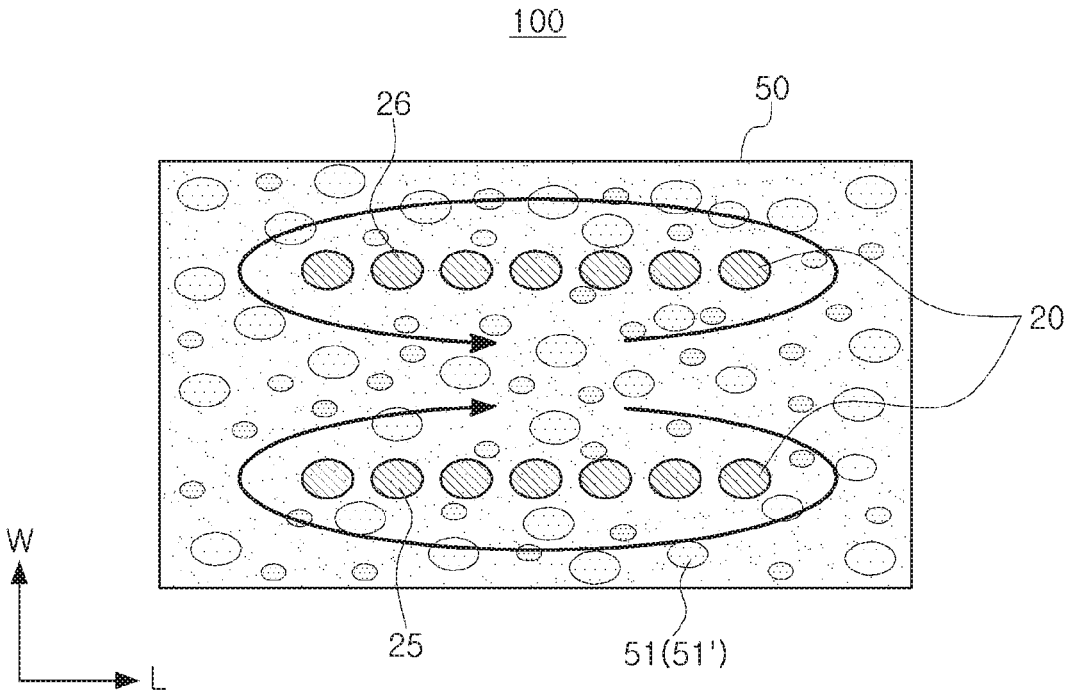
FIG. 6A is a cross-sectional view of a coil electronic component in length-width (L-W) directions according to another exemplary embodiment in the present disclosure.
Figure 6B:
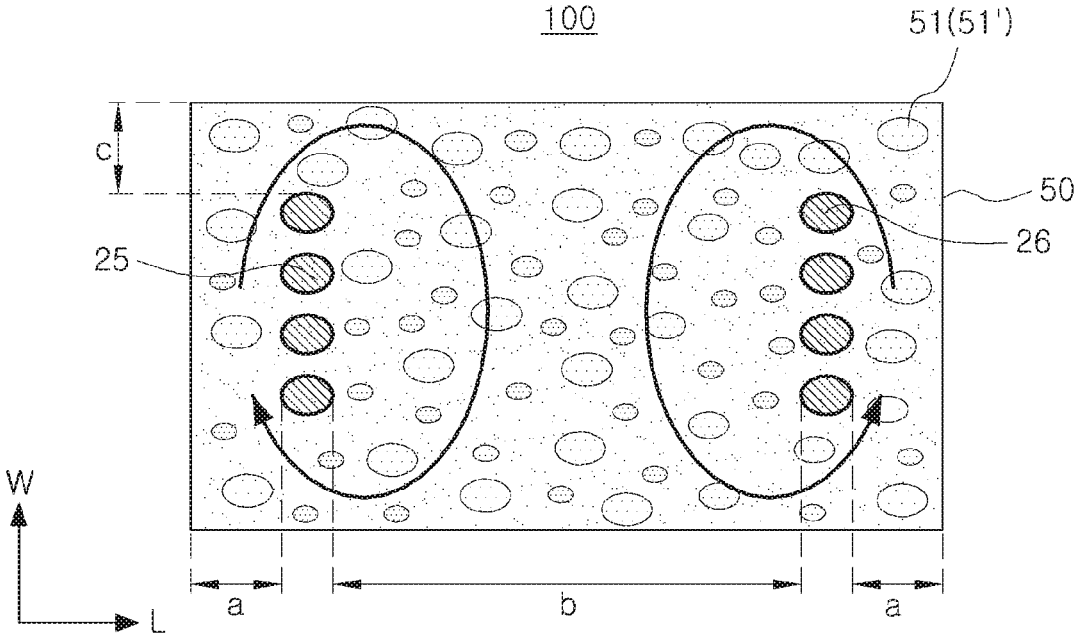
FIG. 6B is a cross-sectional view of a coil electronic component in length-width (L-W) directions according to an exemplary embodiment in the present disclosure.

FIG. 6A is a cross-sectional view of a coil electronic component in length-width (L-W) directions according to another exemplary embodiment in the present disclosure, and FIG. 6B is a cross-sectional view of a coil electronic component in length-width (L-W) directions according to an exemplary embodiment in the present disclosure.

Referring to FIG. 6A, a coil electronic component 100 according to another exemplary embodiment of the present disclosure is formed such that an axis thereof is in the length (L) direction of the body 50.

As illustrated in FIG. 6A, when the coil electronic component 100 is formed such that an axis thereof is in the length (L) direction of the body 50, the number of turns of the coil may be increased but an area of a core part on the inner side of the coil unit 20 may be reduced.

Referring to FIG. 6B, a coil electronic component 100 according to an exemplary embodiment of the present disclosure may be formed such that an axis thereof is in the width (W) direction of the body 50.

As illustrated in FIG. 6B, when coil electronic component 100 is formed such that an axis thereof is in the width (W) direction of the body 50, an area of the core part on the inner side of the coil unit 20 may be increased to advantageously enhance inductance (L) or improve efficiency (Q factor). Although an axial direction of the coil unit 20 is not limited, preferably, the axis of the coil unit 20 is formed in the width (W) direction of the body 50.

Also, in an exemplary embodiment of the present disclosure, a distance b between the first and second through conductors 25 and 26 may be about two times a distance a (the distance between at least one of the first and second through conductors 25 and 26 and the most adjacent surface of the body 50 in the length (L) direction) or c (the distance between at least one of the first and second through conductors 25 and 26 and the most adjacent surface of the body 50 in the width (W) direction).

When the area in which magnetic flux generated by the coil unit 20 within the body 50 flows is the same, it is advantageous for inductance (L) and DC-bias characteristics. Thus, by configuring the distance b between the first and second through conductors 25 and 26 to be about two times, for example, 1.8 to 2.2 times, the distance a between at least one of the first and second through conductors 25 and 26 and one surface of the body 50 in the length (L) direction, and such that the distance a between at least one of the first and second through conductors 25 and 26 and one surface of the body 50 in the length (L) direction is about the same as the distance c between at least one of the first and second through conductors 25 and 26 and one surface of the body 50 in the width (W) direction, inductance L and DC-bias characteristics may be enhanced.

Figure 7A:
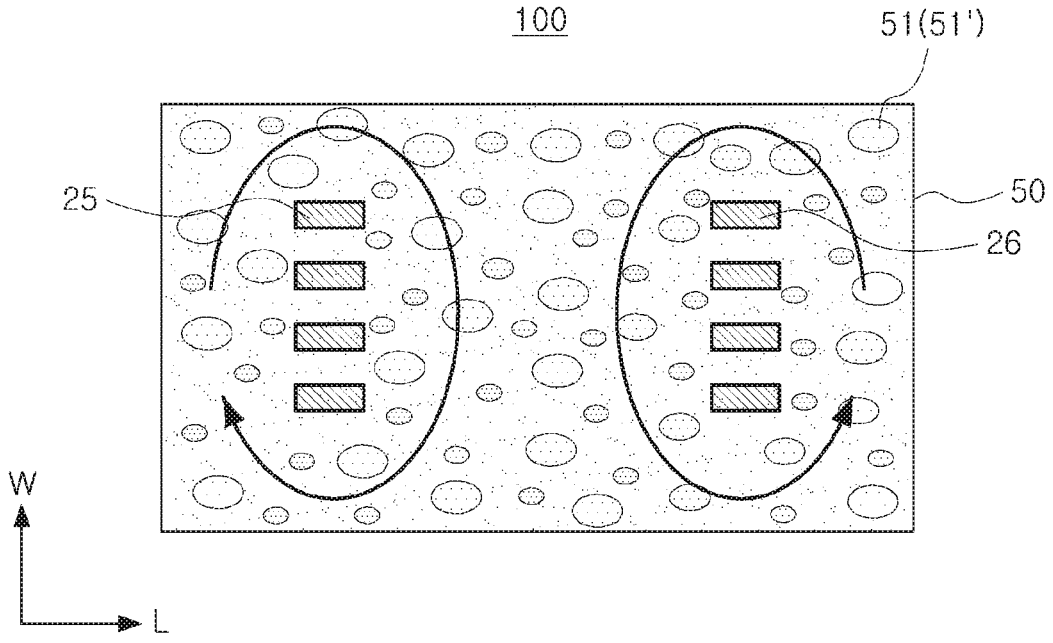
FIGS. 7A and 7B are cross-sectional views of a coil electronic component in length-width (L-W) directions according to another exemplary embodiment in the present disclosure.
Figure 7B:
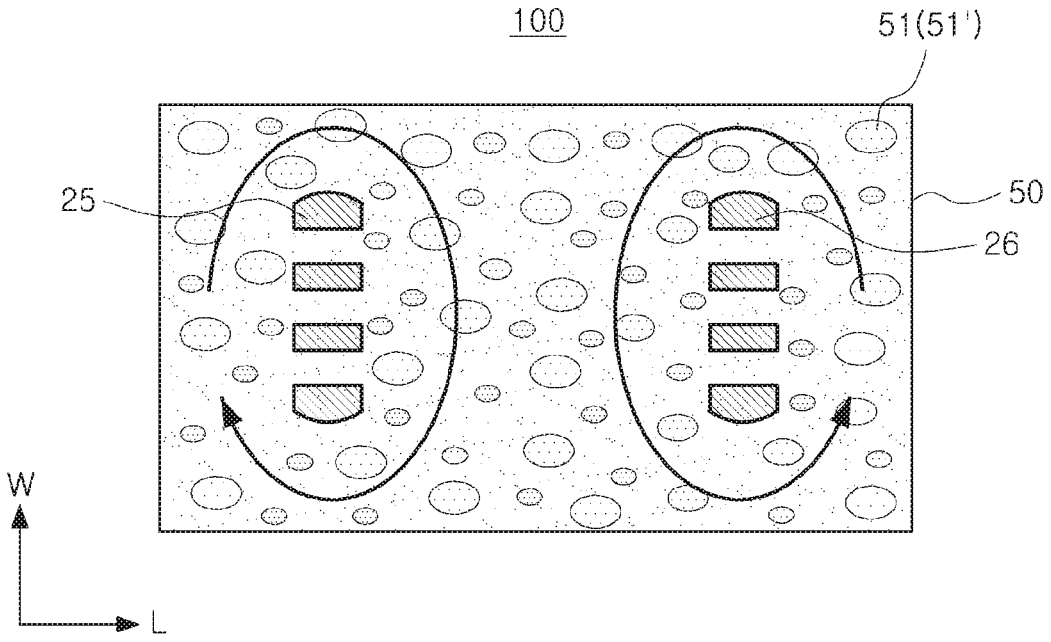

FIGS. 7A and 7B are cross-sectional views of a coil electronic component in length-width (L-W) directions according to another exemplary embodiment in the present disclosure.

In the coil electronic component 100 according to an exemplary embodiment of the present disclosure described above, a cross-section of the first and second through conductors 25 and 26 in the length-width (L-W) direction has a circular shape, but the shape of the cross-section of the first and second through conductors 25 and 26 is not limited thereto and the cross-section of the first and second through conductors 25 and 26 in the length-width (L-W) direction may be one or more selected from the group consisting of oval, semi-oval, and quadrangular shapes.

FIG. 7A illustrates an exemplary embodiment in which the cross-section of the first and second through conductors 25 and 26 in the length-width (L-W) direction has a quadrangular shape. FIG. 7B illustrates an exemplary embodiment in which cross-sections of the first and second through conductors 25 and 26 at the central portion in the length-width (L-W) direction have a quadrangular shape, and the cross-sections of the first and second through conductors 25 and 26 at the outer portion in the length-width (L-W) direction have a quadrangular shape in which one side is convex. In this manner, DC resistance Rdc may be lowered by adjusting the shape of the coil unit 20.

The first and second through conductors 25 and 26 may be formed to be substantially aligned in the length (L) direction or in the width (W) direction of the body 50 such that they are not staggered.

If the first and second through conductors 25 and 26 are formed to be staggered (off-set), the area in which magnetic flux flows is reduced, reducing inductance (L) and the DC-bias characteristics.

Figure 8A:
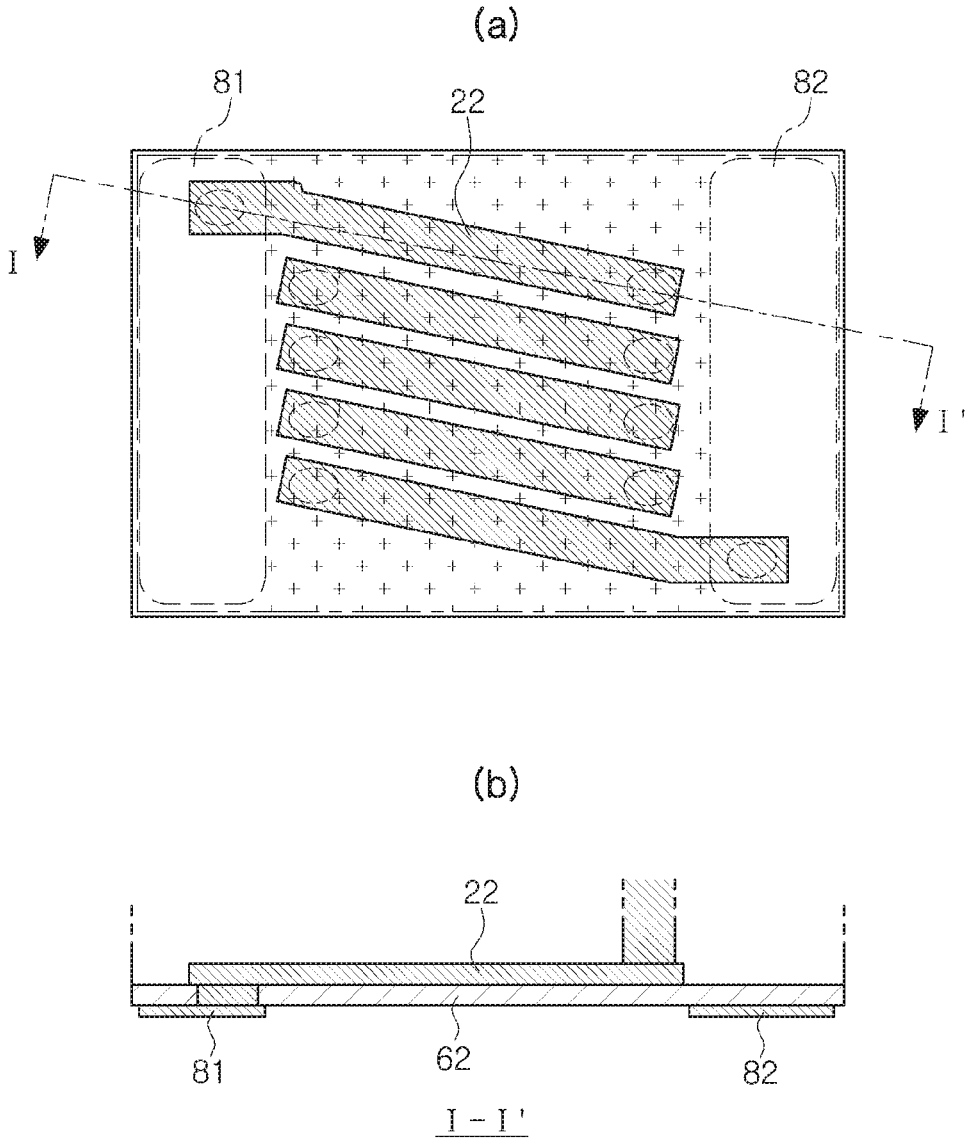
FIGS. 8A and 8B are views illustrating external electrodes of a coil electronic component according to an exemplary embodiment in the present disclosure.
Figure 8B:
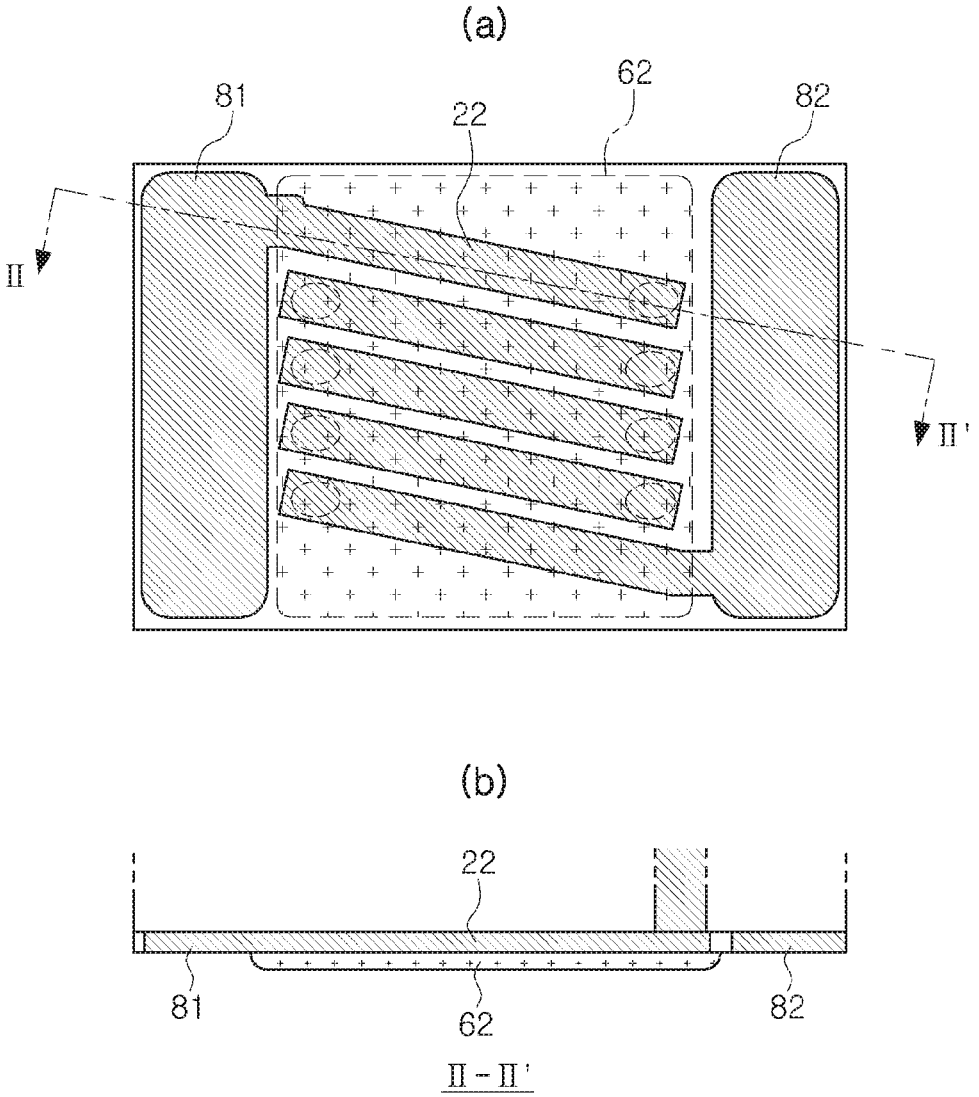

FIGS. 8A and 8B are views illustrating external electrodes of a coil electronic component according to exemplary embodiments in the present disclosure.

Referring to FIG. 8A, in a coil electronic component 100 according to an exemplary embodiment of the present disclosure, first and second external electrodes 81 and 82 are formed on a lower surface of a second insulating layer 62 formed on a lower surface of the body 50. The first and second external electrodes 81 and 82 are electrically connected to a coil unit 20 by a via penetrating through a second insulating layer 62.

Referring to FIG. 8B, in a coil electronic component 100 according to an exemplary embodiment of the present disclosure, first and second external electrodes 81 and 82 extend to a portion of a lower pattern 22 of a coil unit 20 and formed on a lower surface of a body 50.

In the exemplary embodiment shown in FIG. 8B, a second insulating layer 62 is formed only on a portion to which the lower pattern 22 is exposed, excluding portions in which the first and second external electrodes 81 and 82 are formed.

Figure 9:
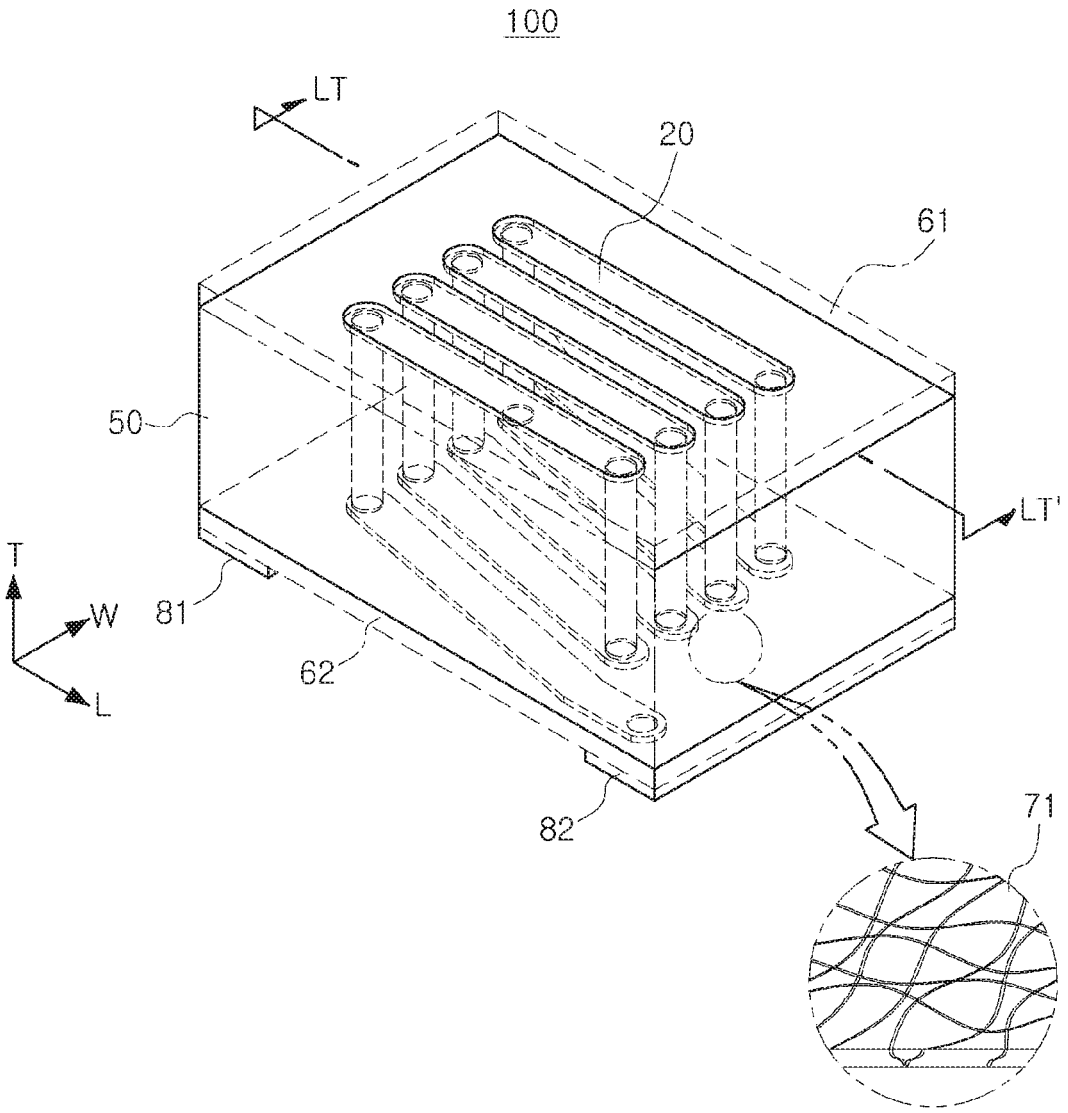
FIG. 9 is a perspective view schematically illustrating a coil electronic component including a coil unit according to another exemplary embodiment in the present disclosure.

FIG. 9 is a perspective view schematically illustrating a coil electronic component including a coil unit according to another exemplary embodiment in the present disclosure.

Referring to FIG. 9, a coil electronic component 100 according to an exemplary embodiment of the present disclosure includes a body 50 including a magnetic metal plate 71, a coil unit 20 disposed in the body 50, and first and second external electrodes 81 and 82 formed on an external surface of the body 50 and electrically connected to the coil unit 20.

In the present exemplary embodiment, the coil unit 20 is formed to have an axis perpendicular with respect to the thickness (T) direction of the body 50, and the magnetic metal plate 71 is arranged to be parallel to a direction of flow of magnetic flux generated by the coil unit 20. That is, the magnetic metal plate 71 is arranged to be disposed on a plane parallel to the length-width (L-W) cross-section of the body 50.

The magnetic metal plate 71 has high magnetic permeability in an amount equal to two to 10 times that of magnetic metal powder, and thus, inductance (L) may be increased by disposing the magnetic metal plate 71 having high magnetic permeability within the body 50.

Magnetic permeability of the magnetic metal plate 71 may differ, however, according to the direction. Thus, even though overall magnetic permeability of the magnetic metal plate 71 is higher than that of magnetic metal powder, magnetic permeability thereof in a particular direction may be lower such that it may hinder the flow of magnetic flux generated by a current applied to the coil unit 20 to resultantly rather reduce inductance.

Thus, in the present exemplary embodiment, the coil unit 20 is formed to have an axis perpendicular with respect to the thickness (T) direction of the body 50 and the magnetic metal plate 71 having high magnetic permeability is arranged to be parallel to a direction of flow of magnetic flux generated by the coil unit 20, whereby magnetic flux may flow smoothly and inductance (L) may be enhanced through the high magnetic permeability.

In other words, in the present exemplary embodiment, the coil unit 20 is formed such that an axis thereof is perpendicular to the thickness (T) direction to allow magnetic flux to flow in the length-width (L-W) cross-sectional direction, and the magnetic metal plate 71 is arranged to be disposed on a plane parallel to the length-width (L-W) cross-section of the body 50.

The magnetic metal plate 71 may be formed of a crystalline or amorphous metal including one or more selected from the group consisting of iron (Fe), silicon (Si), boron (B), chromium (Cr), aluminum (Al), copper (Cu), niobium (Nb), and nickel (Ni).

Figure 10:
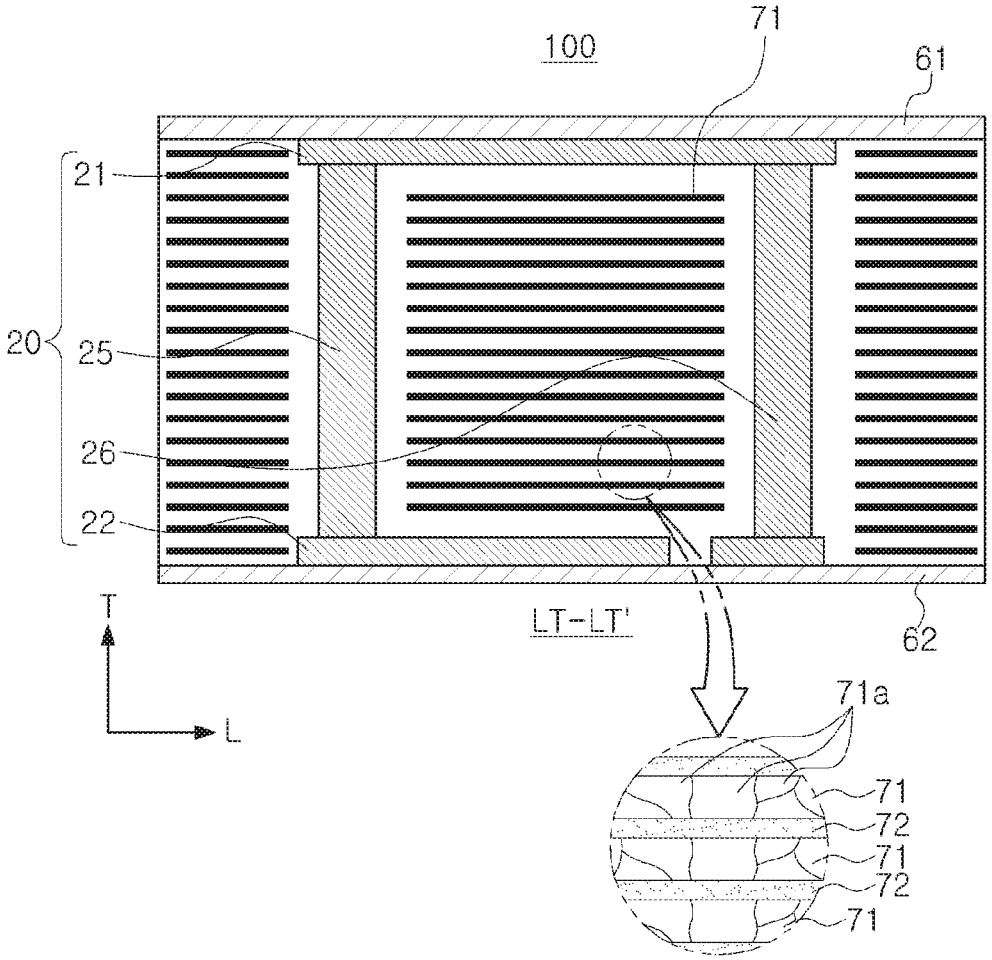
FIG. 10 is a cross-sectional view taken along line LT-LT' of FIG. 9.

FIG. 10 is a cross-sectional view taken along line LT-LT' of FIG. 9.

Referring to FIG. 10, a thermosetting resin layer 72 is formed on at least one surface of the magnetic metal plate 71.

Since the thermosetting resin layer 72 is formed on one surface of the magnetic metal plate 71, the coil electronic component 100 according to an exemplary embodiment in the present disclosure may obtain high magnetic permeability and reduce core loss.

The magnetic metal plate 71 according to the present exemplary embodiment is cracked to include a plurality of metal fragments 71*a*.

The magnetic metal plate 71 exhibits high magnetic permeability about two to ten times greater than that of magnetic metal powder, but if the magnetic metal plate 71 is used in the form of a plate as is, without being cracked, core loss is increased due to eddy currents, which may degrade the Q factor.

Thus, in the present exemplary embodiment, the magnetic metal plate 71 is cracked to form the plurality of metal fragments 71*a* to obtain high magnetic permeability and reduce core loss.

Thus, the coil electronic component 100 according to the present exemplary embodiment may have enhanced magnetic permeability providing an excellent Q factor, while securing high inductance.

The magnetic metal plate 71 is cracked such that adjacent metal fragments 71*a* have shapes corresponding to each other.

After the magnetic metal plate 71 is cracked to form the metal fragments 71*a*, the metal fragments 71*a* are positioned in the cracked state as is, forming a layer, rather than being irregularly dispersed, and thus, the adjacent metal fragments 71*a* have mutually corresponding shapes.

When the adjacent metal fragments 71*a* are said to have mutually corresponding shapes, it means the metal fragments 71*a* are positioned in the cracked state to forma layer as is, rather than that the mutually adjacent metal fragments 71*a* are perfectly matched.

Spaces between the adjacent metal fragments 71*a* of the cracked magnetic metal plate 71 may be filled with a thermosetting resin.

The thermosetting resin may be formed as a thermosetting resin of the thermosetting resin layer 72 formed on one surface of the magnetic metal plate 71 permeates into the spaces between the adjacent metal fragments 71*a* in the process of compressing and cracking the magnetic metal plate 71.

The thermosetting resin filling the spaces between the adjacent metal fragments 71*a* insulates the adjacent metal fragments 71*a*.

Thus, core loss of the magnetic metal plate 71 may be reduced and a Q factor thereof may be enhanced.

The coil unit 20 of the coil electronic component 100 according to the present exemplary embodiment may be formed by forming the magnetic metal plate-organic material complex using the magnetic metal plate 71 and subsequently performing electroplating on the magnetic metal plate-organic material complex.

However, without being limited thereto, any manufacturing process may be applied as long as it can realize such a structure in which the coil unit 20 is formed to have an axis perpendicular with respect to the thickness (T) direction of the body 50 and the magnetic metal plate 71 is arranged to be parallel to the direction of flow of magnetic flux generated by the coil unit 20 as in the present exemplary embodiment.

Other components the same as those of the coil electronic component according to an exemplary embodiment in the present disclosure, excluding the configuration of the magnetic metal plate 71, may be applied in the same manner.

As set forth above, according to exemplary embodiments in the present disclosure, a high level of inductance may be secured and an excellent Q factor and DC-bias characteristics may be obtained.

While exemplary embodiments have been shown and described above, it will be apparent to those skilled in the art that modifications and variations could be made without departing from the scope of the present invention as defined by the appended claims.

What is claimed is:

1. A coil electronic component comprising:

a body including a plurality of magnetic metal plates extending substantially the entire length of the body; and a coil unit disposed in the body and having an axis perpendicular with respect to a thickness direction of the body, wherein the plurality of magnetic metal plates are electrically insulated from the coil unit such that at least a portion of the coil unit intersects planes in which the plurality of magnetic metal plates are disposed, wherein the coil unit includes an upper pattern disposed on an upper surface of the body, a lower pattern disposed on a lower surface of the body, and first and second through conductors connecting the upper and lower patterns through the body and spaced apart from one another, wherein the plurality of magnetic metal plates cover at least a portion of an outer side surface of each of the first and second through conductors, wherein each of the plurality of magnetic metal plates is cracked to include a plurality of metal fragments, such that adjacent metal fragments among the plurality of metal fragments have shapes corresponding to each other, and wherein a portion of the body is filled in an area between the plurality of magnetic metal plates and respective outer side surfaces of the first and second through conductors.

2. The coil electronic component of claim 1, wherein first and second insulating layers are disposed on the upper and lower surfaces of the body, respectively.

3. The coil electronic component of claim 1, wherein a thermosetting resin layer is disposed on at least one surface of each of the plurality of magnetic metal plates.

4. The coil electronic component of claim 1, wherein a thermosetting resin is arranged in spaces between adjacent metal fragments.

5. The coil electronic component of claim 1, further comprising first and second external electrodes disposed on a lower surface of the body and electrically connected to the coil unit.

6. The coil electronic component of claim 1, wherein the plurality of magnetic metal plates comprise at least three magnetic metal plates, at least one of the at least three magnetic metal plates being disposed across a cross-section of the coil unit.

7. The coil electronic component of claim 1, wherein the plurality of magnetic metal plates are arranged to be disposed across a cross-section of the coil unit.

8. The coil electronic component of claim 1, wherein the plurality of magnetic metal plates are disposed between inner side surfaces of the first and second through conductors facing each other.

9. A coil electronic component comprising:

a body including a plurality of magnetic metal plates which are electrically conductive; and a coil unit disposed in the body and having an axis perpendicular with respect to a thickness direction of the body, wherein each of the plurality of magnetic metal plates has openings through which conductors of the coil unit extend, wherein each of the plurality of magnetic metal plates is cracked to include a plurality of metal fragments, such that adjacent metal fragments among the plurality of metal fragments have shapes corresponding to each other, wherein the plurality of magnetic metal plates cover at least a portion of an outer side surface of the conductors of the coil unit, and wherein a portion of the body is filled in an area between the plurality of magnetic metal plates and respective outer side surfaces of the conductors.

10. The coil electronic component of claim 9, wherein the plurality of magnetic metal plates comprise at least three magnetic metal plates, at least one of the at least three magnetic metal plates being disposed across a cross-section of the coil unit.

11. The coil electronic component of claim 9, wherein the plurality of magnetic metal plates are arranged to be disposed across a cross-section of the coil unit.

12. The coil electronic component of claim 9, wherein the plurality of magnetic metal plates are disposed between inner side surfaces of the conductors facing each other.

13. A coil electronic component comprising:

a body including a plurality of magnetic metal plates extending substantially the entire length of the body; and a coil unit disposed in the body and having an axis perpendicular with respect to a thickness direction of the body, wherein the plurality of magnetic metal plates are electrically insulated from the coil unit such that at least a portion of the coil unit intersects planes in which the plurality of magnetic metal plates are disposed, wherein the coil unit includes an upper pattern disposed on an upper surface of the body, a lower pattern disposed on a lower surface of the body, and first and second through conductors connecting the upper and lower patterns through the body and spaced apart from one another, wherein each of the plurality of magnetic metal plates is cracked to include a plurality of metal fragments, such that adjacent metal fragments among the plurality of metal fragments have shapes corresponding to each other, wherein spaces between the adjacent metal fragments contain a thermosetting resin, and wherein a portion of the body is filled in an area between the plurality of magnetic metal plates and respective outer side surfaces of the first and second through conductors.

14. The coil electronic component of claim 13, wherein the plurality of magnetic metal plates are disposed between inner side surfaces of the first and second through conductors facing each other.

* * * * *